US006079135A

United States Patent [19]

Ruiz

[11] Patent Number: 6,079,135

[45] Date of Patent: Jun. 27, 2000

[54] FLEXIBLE IDENTIFICATION COLLAR FOR HOSES

[76] Inventor: Timothy P. Ruiz, 1500 Manning St., Bakersfield, Calif. 93309

[21] Appl. No.: 09/310,877

[22] Filed: May 17, 1999

[51] Int. Cl.[7] ..... G09F 3/00

[52] U.S. Cl. ..... 40/316; 40/665; 40/633

[58] Field of Search ..... 40/665, 633, 316; 2/DIG. 11, 171, 170, 908, 919, 918

[56] References Cited

U.S. PATENT DOCUMENTS

| | | | |
|---|---|---|---|
| D. 374,408 | 10/1996 | McMillan . | |
| 1,238,551 | 8/1917 | Merklee et al. | 40/665 |
| 4,246,712 | 1/1981 | Vander Wall . | |
| 4,612,718 | 9/1986 | Golub et al. | 40/633 |
| 4,844,000 | 7/1989 | Clement . | |
| 5,138,784 | 8/1992 | Niwa . | |
| 5,623,890 | 4/1997 | Lenske . | |

FOREIGN PATENT DOCUMENTS

| | | | |
|---|---|---|---|
| 2160492 | 12/1985 | United Kingdom | 40/633 |

*Primary Examiner*—Cassandra H. Davis
*Attorney, Agent, or Firm*—Dennis W. Beech

[57] ABSTRACT

The flexible identification collar consists of a strap with an attached tongue on one end. The strap is the approximate length of the outer circumference of the hose to which it is to be attached. There is a slot or hole in the strap adjacent to the end opposite the tongue through which the tongue passes when the strap is wrapped around a hose and is then fastened to the strap exterior layer. Use of hook and loop material on the tongue and the exterior and interior layers of the strap serve to secure the tongue and strap end to securely fasten the collar to a hose. In addition hook material or grip material on the interior layer provides a friction surface to prevent slippage on the hose. The exterior layer of the strap will normally be made of a reflective or fluorescent material for improved visibility in low light situations. In addition, an alternate color reflective stripe may be added to the exterior layer as well as a reflective label.

12 Claims, 2 Drawing Sheets

FLEXIBLE IDENTIFICATION COLLAR FOR HOSES

BACKGROUND OF THE INVENTION

1. Field of the Invention

This invention relates to devices used to enhance the identification and visibility of hoses carrying fluids to aid and alert persons as to the location and contents of the hoses. The new device is particularly helpful in low visibility conditions which may occur in the fire fighting, construction, petroleum, aviation and other industries that utilize hoses to transport fluids.

2. Description of Related Art

A primary concern at night for pedestrians, cyclists, drivers, pilots, and safety personnel is the low visibility of objects that may pose a hazard. In urban areas, where night time construction operations are increasingly a common occurrence, the use of air and water hoses have been encountered by the public and sometimes pose a traffic hazard when not adequately marked or identified. Vehicles or cyclists may be damaged or injured when a metal hose coupling is hit, and conversely a hose itself may be damaged by a passing vehicle. At airports, seaports, and at industrial plants where dark rubber hoses are used to convey water, oil, fuel, or sewage, personnel are susceptible to walking into or driving over such hoses particularly in low light areas. During night time operations on naval or commercial ships where inadequate lighting exists, crew members are likely to trip over unmarked hoses or have difficulty identifying what the contents of the hoses are such as an oil, fuel, or water hose having the same outer fabric material. In poorly lit areas such a condition may result in an injury to personnel or damage to a hose and associated appurtenances.

Similarly, fire fighters may experience some difficulty locating fire hoses laid across streets, and hoses previously advanced inside structures during night time conditions. An important aspect to fire fighters is the necessity to have all fire fighting equipment visible and easily identifiable during an emergency situation. It is quite common to see municipal fire departments mark emergency equipment such as fire engines, fire axes, and ladders with highly visible signs, paint, reflecting decals, and lights. These safety measures allow emergency personnel to quickly identify, and subsequently put their emergency equipment into immediate use. However, one of the most important pieces of equipment used for fire suppression is the fire hose which is typically unmarked for night time use. Some fire hoses have been manufactured with a yellow fabric which is highly visible during the day when first purchased; however, shortly after being dragged on oily pavement, dirt, or through charred rubble these types of fire hoses lose their visibility even after being cleaned. Typically, these yellow or orange hoses have no reflective properties. Such low visibility conditions as encountered at night can be improved with the use of high visibility collars having enhanced reflectance properties attached to hoses. The use of such collars to increase visibility of fire hoses is much more economical than purchasing a new hose or painting a hose which may be labor intensive. The high visibility, highly reflective collars may also be used to indicate ownership, hose contents, size and other information indicating whether the contents are hazardous, low hazard, or nonhazardous.

U.S. Pat. No. 4,844,000 issued Jul. 4, 1989 to Clement discloses a flexible band or clamp with directional fingers protruding perpendicular from the band. The band may be visually seen or felt by fire fighters to indicate the direction of the water connection source. The embodiments described include a steel spring clamp capable of being slipped over an unrolled fire hose and a flexible band with fastener which encircles the fire hose and may remain on a stored fire hose. U.S. Pat. No. Des. 312,390 issued Nov. 27, 1990, and U.S. Pat. No. Des. 245,519 issued Mar. 29, 1994, both to Clement, show various embodiments of the directional bands as basically described in Clement's Patent No. 4,844,000.

However, various problems may occur with using the Clement inventions if not used with water conveying fire hoses. For example, the spring clamp embodiment can corrode if made from flexible steel; when in contact with chemicals or salt water the steel must be covered with some suitable corrosion and heat resistant material. Secondly, the clamp embodiment must have an opening along its circumference allowing attachment onto the fire hose; therefore, the resulting sharp edges of the metal spring clamp must be rolled to avoid tearing the fire hose. Third, the steel spring clamp, being a ferrous metal, could cause a spark when it is scraped against a hard surface such as concrete while the fire hose is being dragged. Such a condition creates a dangerous situation for emergency personnel when the hard surface has spillage with a flammable liquid such as gasoline; fire fighters have routinely encountered vehicles damaged by accidents leaking flammable liquids onto street and highway pavement.

Furthermore, the embodiments of U.S. Pat. No. Des. 312,390 and U.S. Pat. No. Des. 245,519 do not allow for night time visual identification of a fuel, oil, or water hose with different coupling system other than threaded couplings.

U.S. Pat. No. 5,623,890 issued Apr. 29, 1997 to Lenske, discloses a fire hose coupling indicating the direction to a safe exit by both tactile and visual means. The coupling can be attached to a threaded end of a fire hose; however, the embodiment of the U.S. Pat. No. 5,623,890 does not allow for the attachment to hoses with different coupling systems such as a non-threaded quick-connect couplings or to the non-coupling portion of the hose.

U.S. Pat. No. 5,027,741 issued Jul. 2, 1991 to Smith, et al. discloses an embodiment for a fire hose with annular members attached to the outside surface of the hose with clasps for providing a direction for escaping a fire. U.S. Pat. No. 5,027,741 does not disclose a preferred material for the annular members, the flexibility of the annular member, nor whether or not the annular member is corrosion resistant to be used with other chemical conveying hoses. Such an embodiment may therefore not be suitable for other types of hoses other than conventional canvas jacketed rubber fire hoses.

In addition to the above, another practical use for a high visibility collar is for the identification of hoses used in various construction projects. In dark underground projects such as mines and tunnels where air and water hoses are commonly used, the subject device will enhance the visibility and identification of such hoses. Similarly, overhead and ground hoses used in conjunction with oil drilling operations may be more visible to drilling crew members when visibility collars are applied.

U.S. Pat. No. 5,138,784 issued Aug. 18, 1992 to Niwa discloses a pipe marking collar comprising of "C" shaped flexible bands clamped onto a pipe. The marking collar may have colors or symbols to indicate the contents of the pipe or direction of flow. U.S. Pat. No. 5,138,784 further discloses the material of the collars being made out of kevlar or plastic. Although U.S. Pat. No. 5,138,784 allows for the attachment to a rigid pipe, the invention does not allow a means of attachment to a flexible hose where it must be able to withstand the sudden expansion or change in shape caused by high fluid pressure such as occurs through a fire hose. Furthermore U.S. Pat. No. 5,138,784 has an inherent problem when it cannot be attached to a hose which may be stored in a flattened coil or roll and then put into immediate use such as a fire hose.

U.S. Pat. No. 4,246,712 issued Jan. 27, 1981 to Vander Wall discloses an identification system for pipe and conduit which includes a marker of rigid material used to indicate the nature of contents and flow direction. Use of this invention may work on a fixed rigid item such as a pipe; however, a problem occurs when the marker cannot be attached to a flexible hose which may be dragged on the ground when in use. A fundamental aspect to carrying out any operation whether related to fire fighting or construction work is safety. The application of safety devices to make equipment more visible, such as the high visibility hose collar, will ultimately contribute to the prevention of accidents, injuries, and property damage.

SUMMARY OF THE INVENTION

One object of the present invention is to enhance visibility of fluid carrying hoses at intervals along the length of a hose. Another object is to allow placement of identifying information relative to the hose, its contents, flow direction and the like at locations along the length of a hose. A further object of the invention is to allow ease of attachment to and removal from a hose. Another object is to reduce slippage of the collar along or relative to the hose. Yet another object is flexibility such that the collar can conform to the shape and size of flexible hose when carrying or not carrying fluid.

In accordance with the description presented herein, other objectives of this invention will become apparent when the description and drawings are reviewed.

BRIEF DESCRIPTION OF THE PREFERRED EMBODIMENT

The flexible identification collar consists of a strap with an attached tongue on one end. The strap is the approximate length of the outer circumference of the hose to which it is to be attached. There is an aperture in the strap adjacent to the end opposite the tongue through which the tongue passes when the strap is wrapped around a hose and is then fastened to the strap exterior layer.

Figure 1:
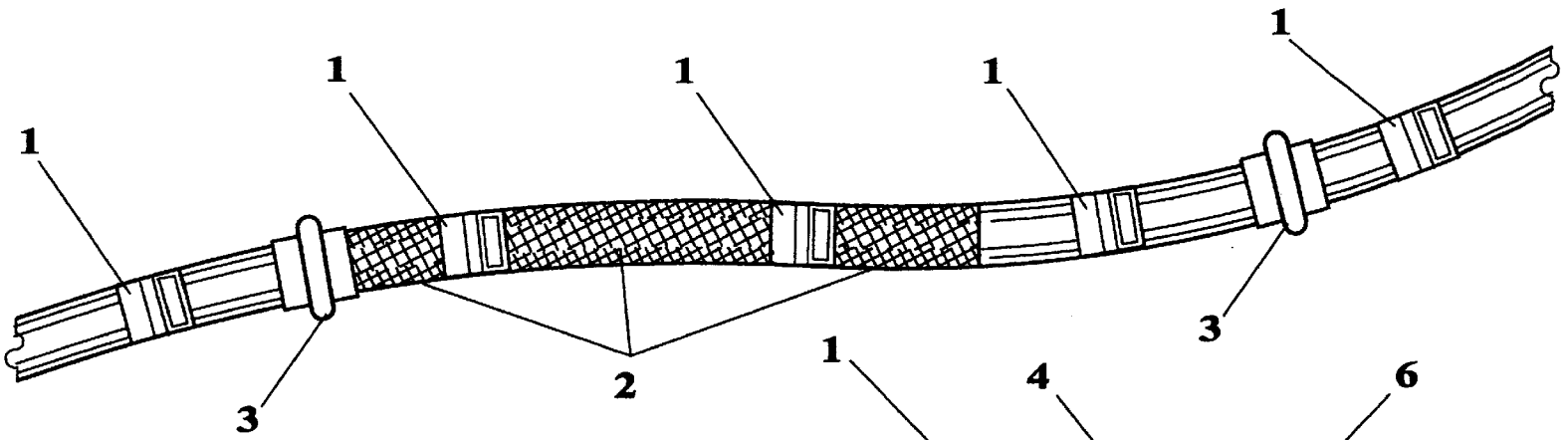
FIG. 1 illustrates a side view of a multi-element hose with multiple collars attached.
Figure 3:
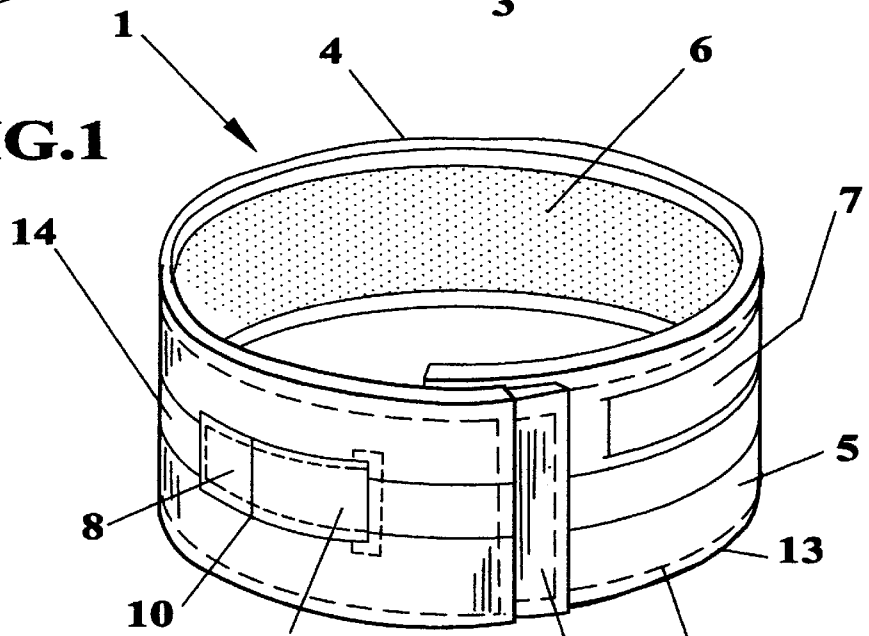
FIG. 3 illustrates a perspective view of the invention in a circular configuration.
Figure 2:
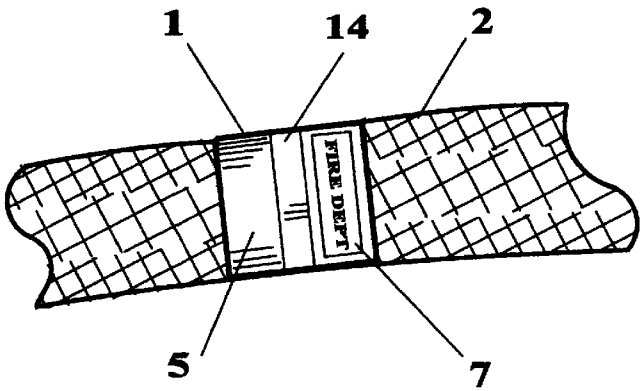
FIG. 2 illustrates a side view hose section with collar attached.
Figure 4:
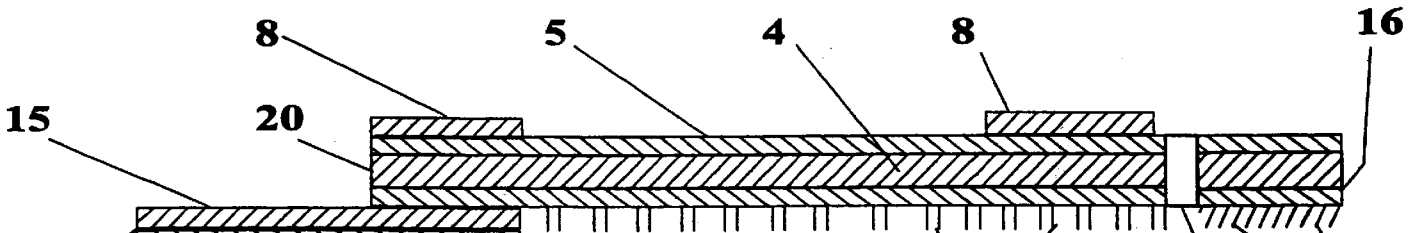
FIG. 4 illustrates a longitudinal sectional side view of the collar in an elongated or flat configuration along line 5 5 of FIG. 5.
Figure 5:
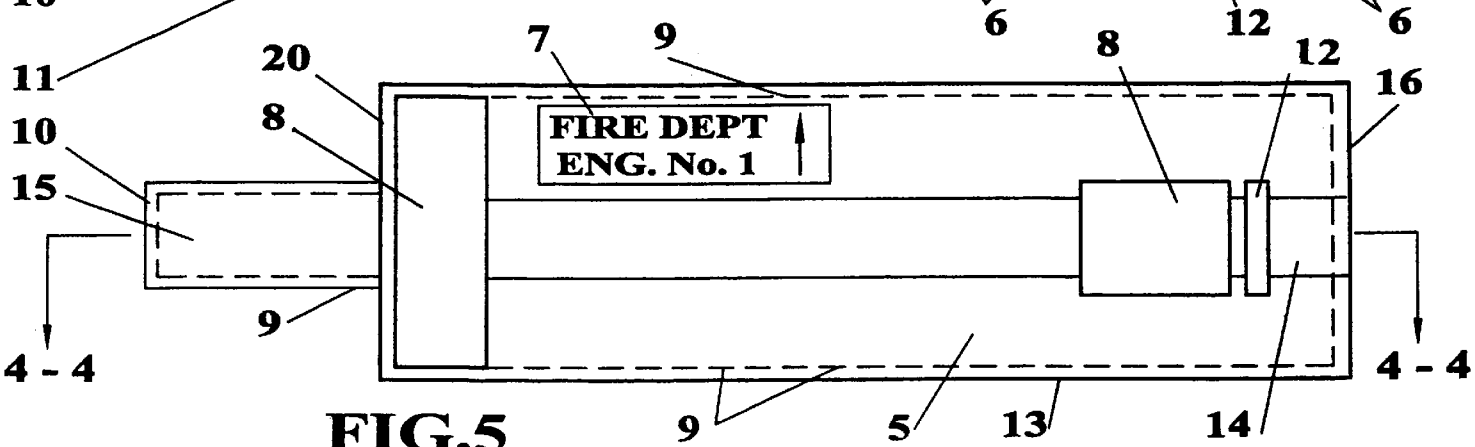
FIG. 5 illustrates a top plan view of the collar in a flattened, extended configuration.
Figure 6:
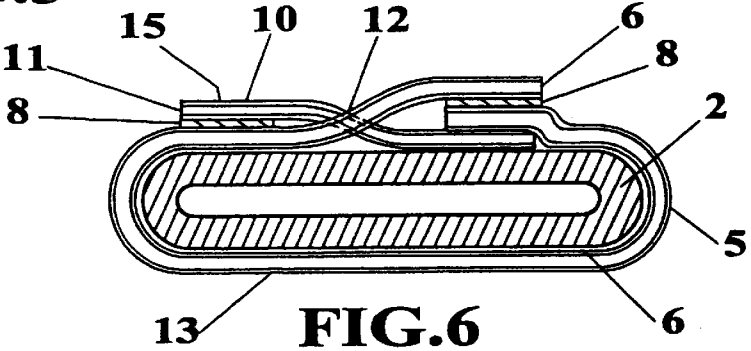
FIG. 6 illustrates a longitudinal side view of the collar attached to a hose, shown sectioned, which is in a non-use oval or flattened condition.

Referring to FIGS. 1 and 2, the flexible identification collar (1) is shown attached to a multi-element hose (2) having couplings (3). The collar (1) may have a label (7) of reflective material having identification information thereon such as the owner, an arrow for fluid flow direction, type of fluid and the like. The collar (1) may also have a stripe (14) of reflective or fluorescent material of a different color than the exterior layer (5) of the collar (1) to further highlight or differentiate the collar (1) from the hose (2) for visibility.

Referring to FIGS. 3 through 6, a collar (1) has a tongue (10) attached at a tongue end (20) of a strap (13) preferably by stitching. The strap (13) has three layers comprising an exterior layer (5), intermediate layer (4) and hose layer (6) all attached preferably by stitching (9) or other suitable means depending on the material and intended use. The exterior layer (5) is generally formed of an abrasive resistant material, and where fire may be encountered as in fire fighting a flame resistant material, that is coated or treated to be reflective or fluorescent.

The intermediate layer (4) is formed of a strong web construction to provide strength for the strap (13). Such web construction is generally of synthetic material such as polypropylene. The hose layer (6), which rests against the hose (2) outer surface when the collar is wrapped around the hose (2), is formed of a material for high friction force with the hose (2) surface. Examples of such material for the hose layer (6) relative to hose surfaces include the plastic hook material of hook and loop fabric as for example Velcro™ or Super Grip™ and Ultra Grip™ of the Rubbermaid™ Corporation. The hose layer (6) may also be alternating forms of fabric to provide friction for a wide variety of applications.

The tongue (10) is similarly layered having two layers; an exterior retroreflective tongue layer (15) of the abrasive resistant and flame resistant, if appropriate, type material and an interior tongue layer (11) of hook material. The tongue (10) is of a width to pass through an aperture (12) formed in the strap (13) at the aperture end (16) opposite the tongue end (20). The collar (1) is attached around a hose (2) by wrapping the strap (13) around the hose (2), passing the tongue (10) through aperture (12), fastening the tongue (10) to a loop material strip (8) attached to exterior layer (5), and fastening aperture end (16) to a loop material strip (8) attached to exterior layer (5) at the tongue end (20).

The exterior layer material of flame resistance, reflective fabric may be of the ScotchliteTM family of fabric manufactured by the 3M™ company. As with all reflective material mentioned herein, the material may be retroreflective as for example for the label (7) if such specific qualities aid in recognition in a given environment. For flame resistant conditions, thread such a NomeX$_{TM}$ or Kevlar$_{TM}$ manufactured by the Dupont$_{TM}$ Corporation may be used for stitching. The number of collars (1) used with a hose (2) depends on hose (2) length and intended use. It is recommended at least three collars (1) per hose element be used, one at each end and one in the middle. The flexibility of the collar (1) and structure of the fastening of the collar (1) and tongue (10) provide for strength of retention on the hose (2) whether under pressure or stored in a flattened condition.

While the invention has been particularly shown and described with respect to the illustrated and preferred embodiments thereof, it will be understood by those skilled in the art that the foregoing and other changes in form and details may be made therein without departing from the spirit and scope of the invention.

I claim:

1. A device for wrapping around and retention on fluid hoses comprising:

a flexible strap having attached a tongue on a tongue end and an aperture end having an aperture formed therein;

the flexible strap comprised of an exterior strap layer, a hose layer and an intermediate layer there between all attached by a means for attachment;

the tongue comprised of an exterior tongue layer attached to an interior tongue layer; and the flexible strap of a length to be wrapable around a fluid hose wherein the tongue passes through the aperture and fastens to the exterior strap layer by a tongue means for fastening.

2. The device as in claim 1 wherein the aperture end fastens to the exterior strap layer by a second means for fastening.

3. The device as in claim 1 wherein the hose layer is a hook material.

4. The device as in claim 1 wherein the interior tongue layer is a hook material.

5. The device as in claim 2 wherein the second means for fastening is a loop material strip attached to the exterior strap layer which receives a hook material of the hose layer.

6. The device as in claim 4 wherein the tongue means for fastening is a loop material strip attached to the exterior strap layer at the aperture end which receives the hook material.

7. The device as in claim 1 wherein the hose layer having a friction surface for positioning against the fluid hose.

8. The device as in claim 1 wherein the exterior strap layer is reflective.

9. The device as in claim 1 wherein the exterior strap layer is fluorescent.

10. The device as in claim 9 wherein there is a stripe of a color different than the exterior surface strap layer on said exterior strap layer and the stripe is a reflective material.

11. The device as in claim 1 wherein there is a label of reflective material attached to the exterior strap layer.

12. The device as in claim 1 wherein the exterior strap layer having an indice thereon.

* * * * *